United States Patent [19]

Danford

[11] 3,981,083

[45] Sept. 21, 1976

[54] GRAIN STORAGE AND SHIPPING CONTAINERS

[76] Inventor: Jack Dewayne Danford, 1450 S. Havana - Suite 340, Aurora, Colo. 80012

[22] Filed: June 9, 1975

[21] Appl. No.: 585,023

Related U.S. Application Data

[63] Continuation-in-part of Ser. No. 488,264, July 15, 1974, Pat. No. 3,893,244.

[52] U.S. Cl. ..... 34/19; 34/225; 34/237

[51] Int. Cl.[2] ..... F26B 7/00; F26B 25/10

[58] Field of Search ..... 34/19, 22, 210, 222, 34/225, 237

[56] References Cited

UNITED STATES PATENTS

| | | | |
|---|---|---|---|
| 1,108,565 | 8/1914 | Feuillette | 34/210 X |
| 2,132,095 | 10/1938 | Broughton | 34/19 X |
| 3,097,916 | 7/1963 | Dawson et al. | 34/22 |
| 3,727,323 | 4/1973 | Meiners | 34/210 |
| 3,893,244 | 7/1975 | Danford | 34/19 |

*Primary Examiner*—John J. Camby

[57] ABSTRACT

A container for receiving and retaining loose bulk grain from point of harvest to destination comprises a generally rectangular box-like receptacle having side and end walls, a bottom wall, and an open upper end with a closure. First airflow port means is provided in at least one side wall and second airflow port means is provided in an end wall. Bulk grain is loaded into a multitude of such containers and the closures are secured in place. A fan is connected to one of the port means to force a stream of atmospheric air in through one port means and out through the other, the air flowing through substantially all of the body of grain in the receptacle and removing a excess moisture. The grain is stored in the receptacles as long as necessary and then shipped in the original receptacles to any desired location for processing. Means are provided to interlock groups of containers on the transport means to prevent any inadvertent displacement of individual containers.

6 Claims, 10 Drawing Figures

GRAIN STORAGE AND SHIPPING CONTAINERS

This application is a continuation-in-part of my U.S. patent application Ser. No. 488,264, filed July 15, 1974, now U.S. Pat. No. 3,893,244, and entitled "Grain Storage and Shipping Containers".

BACKGROUND OF THE INVENTION

This invention lies in the field of storing and shipping grain in loose bulk form and is directed to means and methods for initially loading, storing and delivering with a minimum amount of handling and transferring of the cargo and without damage to the grain itself.

The conventional systems for bringing grain, such as corn, wheat, and the like, from the point of harvest to the destination for processing are complicated and expensive and involve a substantial amount of damage to the grain. They also provide no suitable way of drying the grain to the desired level and protecting it from again picking up any undesired moisture.

Ordinarily, the grain is first loaded onto a truck in the field, after which it is dumped into a silo or other storage device. From there it is loaded onto trucks for shipping to railroad cars where it is again loaded onto the cars. At the destination it is again dumped. In the event that the destination is overseas, the railroad cars must be taken to a port where the grain is then reloaded into a ship. At the foreign port, the grain is again loaded from the ship onto other vehicles and transferred to a final destination for another dumping operation. With each loading or reloading, some of the grain is crushed and damaged, so that by the time it reaches its destination it is not of extremely high quality.

SUMMARY OF THE INVENTION

The means and methods of the present invention overcome the various difficulties and disadvantages mentioned above and provide a simple and reliable system for storing and transporting grain from the point of harvest to the final destination and for protecting the quality of the grain during the elapsed period of time.

Generally stated, the system of the invention comprises initially loading the grain in the field into individual containers of substantial size, storing the grain in the containers for any required period of time, which may be several months, reducing the moisture in the grain during the storage period, and delivering the grain to its final destination still held in the original containers.

Each container of one embodiment comprises a generally rectangular box-like receptacle having side and end walls, a bottom wall, and an open upper end provided with suitable closure means. First airflow port means is provided in at least one side wall near the top and second airflow port means in an end wall near the bottom. When the grain is loaded and the container is moved to its storage location, a fan is connected to one of the port means to produce a flow of atmospheric air in through one of the port means and out through the other. The air spreads out in the container and flows through substantially the entire body of the cargo between the port means to remove the excess moisture from the grain. This treatment is necessary because at the time of harvesting the grain is moist, and mildew and spoilage will soon occur unless it is periodically aerated and dried until such time as it becomes completely dry. A moisture probe may be inserted through a wall of the container into the midportion of the grain to indicate the level of the remaining moisture. The ventilating treatment may then be continued or renewed if it is found to be necessary.

In another embodiment, inlet ports are provided in a top wall for filling the container and one of the end walls is closed by hinged doors which may be opened to empty the product, such as grain, from the container and be used for refilling with other bulk products. Conveniently, pressure relief ports may be provided in the doors to relieve pressure of the grain against the doors prior to unloading.

The vertical margins of the side and end walls are joined to vertical columns to form reinforced corners, and the columns are configured so that the upper and lower end nest with vertically adjacent column ends. Registered lateral apertures are formed through the ends to receive locking pins which prevent vertical separation of the stacked containers.

Hoisting eyes are secured to the corners of the containers, and when a group of containers is arranged in endwise and lateral adjacency, other locking pins are inserted through adjacent eyes to retain the group in a substantially unitary assembly and prevent inadvertent displacement of any of the containers.

BRIEF DESCRIPTION OF THE DRAWINGS

Various other advantages and features of novelty will become apparent as the description proceeds in conjunction with the accompanying drawings, in which.

DESCRIPTION OF THE PREFERRED EMBODIMENTS

Figure 1:
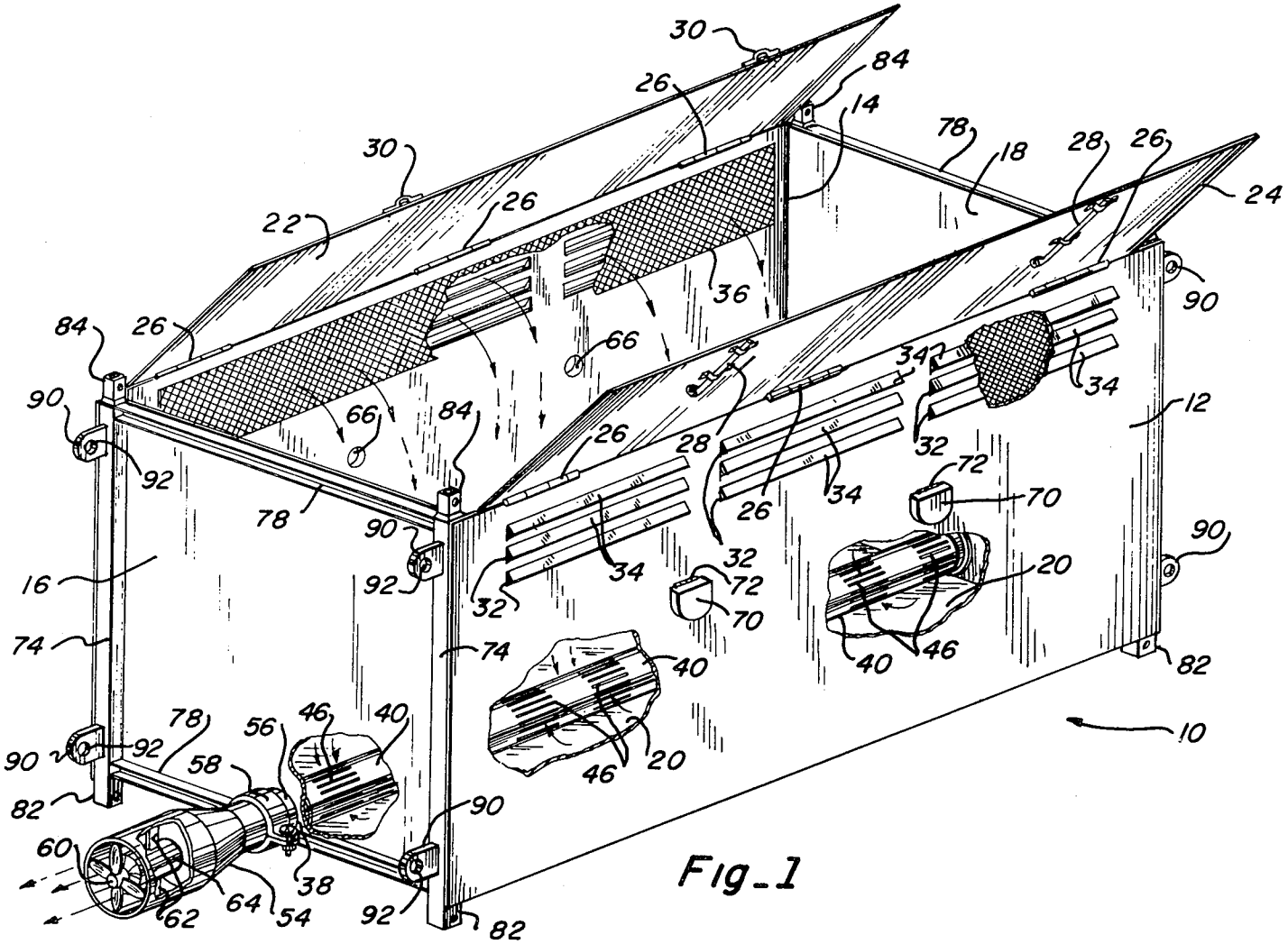
FIG. 1 is a diagrammatic perspective view of the container including the ventilation components.

A container incorporating many features of the invention is diagrammatically illustrated in FIG. 1, in which a receptacle 10 includes side walls 12 and 14, end walls 16 and 18, a bottom wall 20, and closure members 22 and 24 pivotally connected to the upper margins of the side walls by hinges 26 and provided with slide bolts 28 and eyes 30 for securing members 22 and 24 in closed position across the open upper end of the receptacle. First airflow port means are provided at the upper portions only of at least one and preferably both of the side walls and comprise a plurality of elongate narrow horizontal slots 32 through the wall formed by piercing the wall and bending out the vanes 34. The slots extend along the major port of the length of the wall to permit the flow of air into or out of the upper part of the receptacle throughout its length. The downwardly and outwardly sloping vanes keep moisture, such as rain, out and screens 36 are mounted on the inner wall faces to prevent small sized grain from working out through the slots.

Figure 4:
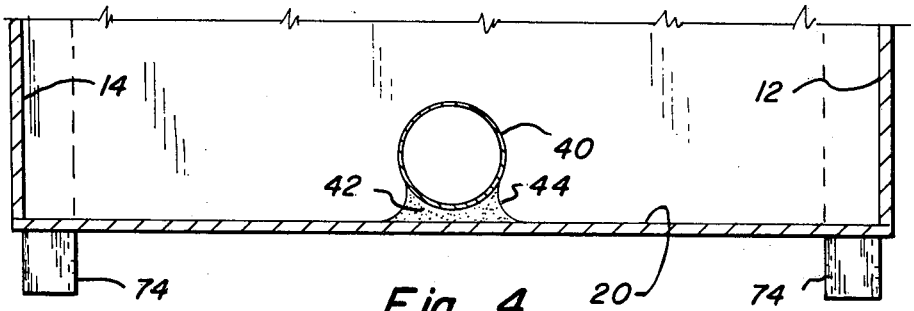
FIG. 4 is a sectional view taken on line 4—4 of FIG. 3.
Figure 5:
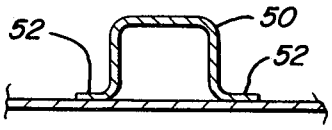
FIG. 5 is a view similar to FIG. 4 showing a modification.

Second airflow port means is provided in end wall 16 in the form of aperture 38 in the lower portion of the wall below the level of the major portion of the body of grain to be carried in the receptacle. A tube 40 is located adjacent to the bottom wall 20 and extends substantially the full length of the receptacle generally parallel to the side walls and preferably substantially on the axis of the bottom wall, and is secured thereto by elongate mounting means 42, FIGS. 3 and 4, which may be a plastic mass having fillets 44 to prevent grain from lodging beneath the tube. Narrow elongate slits 46 are formed through the tube wall around the exposed portions of its periphery and along most of its length to provide for flow of air into and out of the tube. The first end of the tube extends through aperture 38 to the exterior and is secured to wall 16 by brackets 48. In the modification of FIG. 5, the tube is formed of an elongate inverted U-shaped channel 50 having elongate side flanges 52 secured to the bottom wall by rivets or other conventional means, and a short tube, not shown, may be inserted in its end to extend out through aperture 38. Channel 50 is provided with elongate slits for air flow through its wall and in all respects it is equivalent to tube 40. In either form, the tube may abut imperforate wall 12 or stop.short and have a partial or total closure to prevent excessive air flow.

Power operated means to produce a stream of air flowing through the port means and through the cargo of grain comprises a housing 54 sized and shaped to telescopingly engage the exterior extension or mounting tube 56 of tube 40 and detachably held in position by clamp 58, and a fan 60 mounted in the outer end of the housing by brackets 62 and driven by motor 64. The fan may be arranged to draw air out of tube 40 or force it into the tube. It is presently preferred to draw air out of the tube.

After the receptacle has been loaded with grain and the closure means fastened, it is transported to a storage location where it remains until the time for shipment arrives. The fan assembly is then connecteed to extension 56 and placed in operation. Ambient atmospheric air is drawn in through the entire lengths of the first port means at the top of the cargo, spreads out across the width of the receptacle and flows down through the grain, entering slits 46 all along the length of the tube, and then flows out through housing 54. The air flow thus contacts the major part of the body of grain and withdraws moisture therefrom. The small part of the grain which misses the flow gradually gives up its moisture in an equalizing operation, and continuation of the air flow gradually removes this moisture also. The fan may be operated continuously or intermittently for long periods of time until the desired result is achieved, and may be activated again at a later time if the grain picks up additional moisture during long storage. The fan may, of course, be connected and disconnected readily so that it may be used with many different containers.

Figure 2:
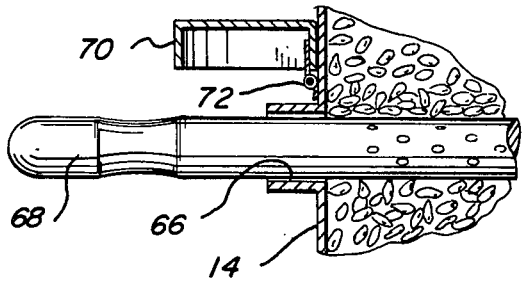
FIG. 2 is a diagrammatic vertical sectional view of the moisture probe inserted through the container wall.

Provision is made for checking the moisture content of the grain from time to time. As seen in FIGS. 1 and 2, several flanged apertures 66 are formed in side walls 12 and 14 through which a probe 68 may be inserted well into the body of grain to indicate its moisture content. A flanged cap 70 is pivotally mounted to the side wall at 72 to cover aperture 66 when the probe is not in use. The cap protects the contents against rain and the like and also prevents loss of grain through the aperture.

Figure 3:
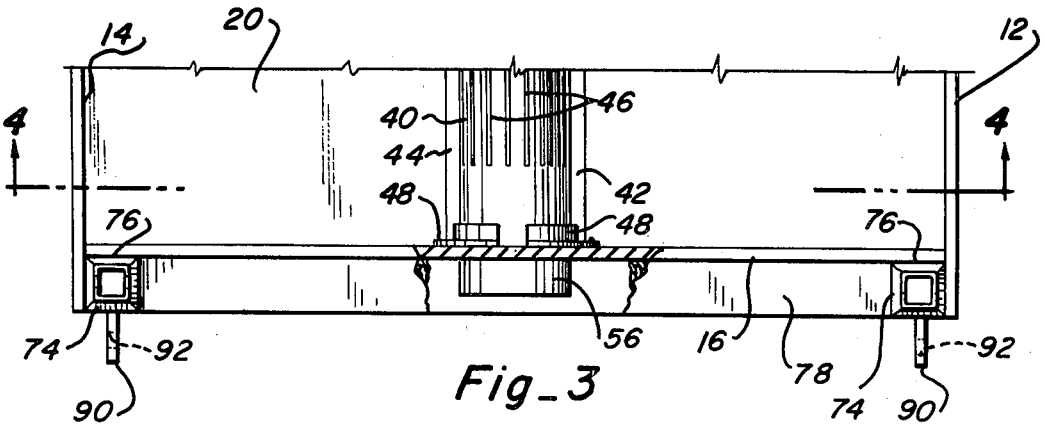
FIG. 3 is a plan view of an end portion of the container.
Figures 6, 7, 8:
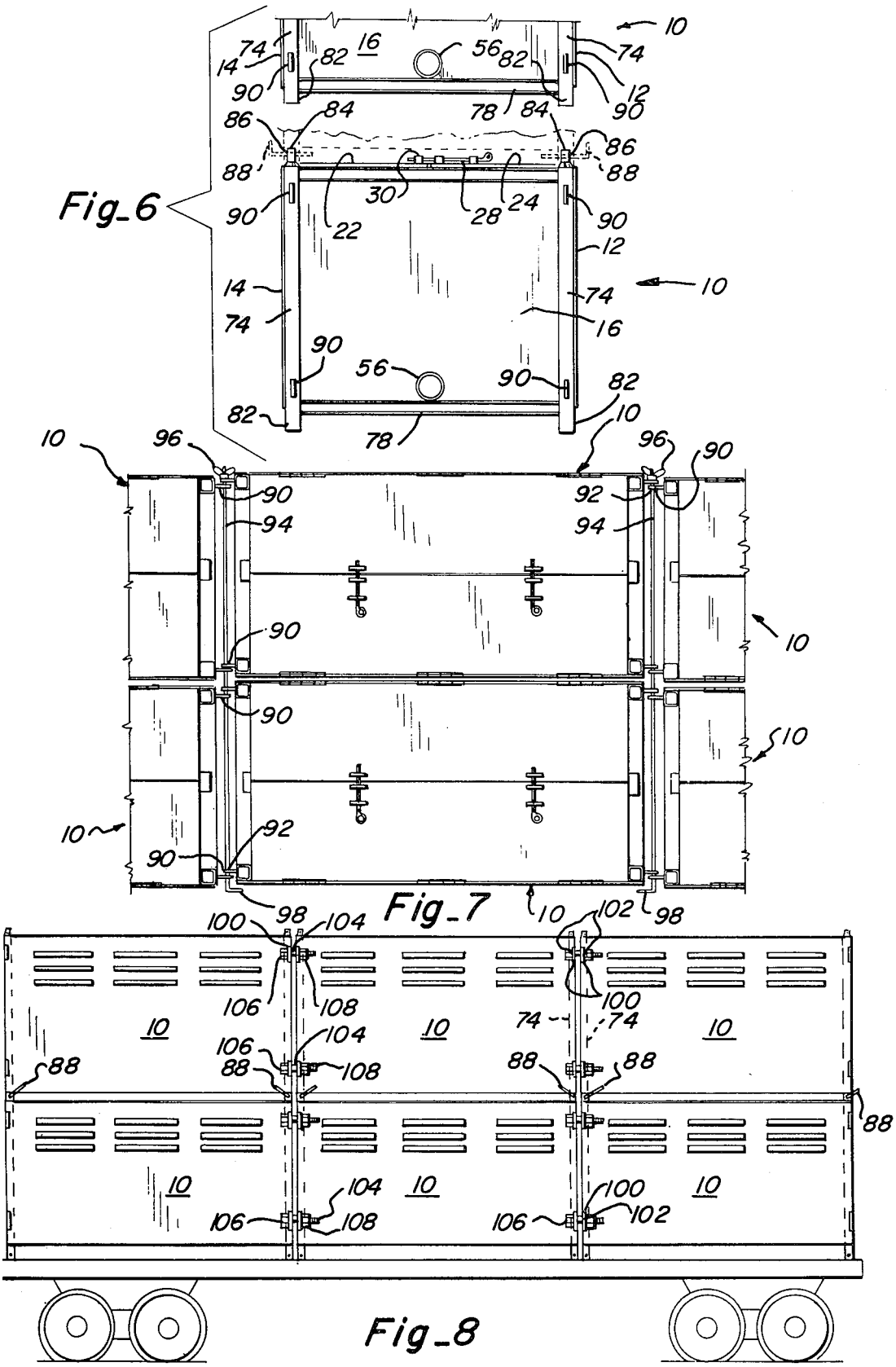
FIG. 6 is an end elevational view of two superimposed containers.
FIG. 7 is a diagrammatic plan view of a group of interlocked containers.
FIG. 8 is a diagrammatic side elevational view of a group of interlocked containers.

As seen in FIGS. 3 and 6, the upright corners of the receptacle are formed by providing upright hollow columns 74 of rectangular cross section to which the side and end wall margins are secured. In FIG. 3 it will be seen that the end walls 16 and 18 are secured to the inner confronting faces 76 of the two adjacent columns to define a shallow channel 78 opening outward, and the horizontal length of mounting tube 56 is no greater than the depth of channel 78. Thus the mounting tube is protected by columns 74 from damage by longitudinally adjacent containers.

In FIG. 6 a first receptacle or container 10 is shown in end elevation standing on a platform or deck 80 of a transport vehicle with a second container 10 superimposed over it in vertical registry. The lower end 82 of each column may be flush with the bottom of the container or extend downward a short distance to form a foot as shown. The upper end 84 extends upward a short distance above the top of the container and is necked down to such an extent that its outer lateral dimensions are less than the inner lateral dimensions of the remainder of the column to permit it to be nested within foot 82 of the the column above it. Laterally extending apertures 86 are formed through ends 82 and 84 in positions to be in registry when the columns are nested as indicated in broken lines. Locking pins 88 are passed through the apertures and secure the two containers against vertical separation.

FIG. 7 very schematically shows in plan view a group of containers 10 stacked vertically and arranged in both endwise and lateral adjacency. Upper and lower hoisting eyes 90 are secured to each corner of each container to be engaged by the hooks of hoist cables for raising, lowering and maneuvering the containers from time to time. The eyes extend fore and aft away from the container in a direction perpendicular to the plane of the end wall, and are formed with laterally directed apertures 92.

The containers are adjusted until all of the eyes at the confronting ends of adjacent containers overlap as shown and all of the apertures 92 are in registry. A long locking pin 94 is then passed through all of the apertures in one row, and a nut 96 is threaded onto the end of each pin. The handle 98 on each pin and nut 96 cooperate to serve as abutments to prevent lateral separation of the containers, and the pins operate in shear to prevent endwise separation. It will be understood that the containers are also stacked vertically and the columns locked by pins 88 to prevent vertical separation. Thus the entire group is interlocked into a substantially unitary assembly which prevents inadvertent displacement of any container from the group in any direction.

Another modification is very diagrammatically illustrated in side elevation in FIG. 8. In this form the containers are stacked vertically and arranged in endwise adjacency but there is not an additional group in lateral adjacency. The columns 74 are locked by pins 88 against vertical separation as before. However, in this form, the hoisting eyes 100 extend laterally away from the container in a direction perpendicular to the plane of the side wall and the apertures 102 of the eyes are directed fore and aft parallel to the side wall. Since they are in the same location on each container the adjacent eyes are in registry, and bolts 104 with head 106 are passed through adjacent eyes. Nuts 108 are threaded on the bolts to lock adjacent containers together.

Figures 9, 10:
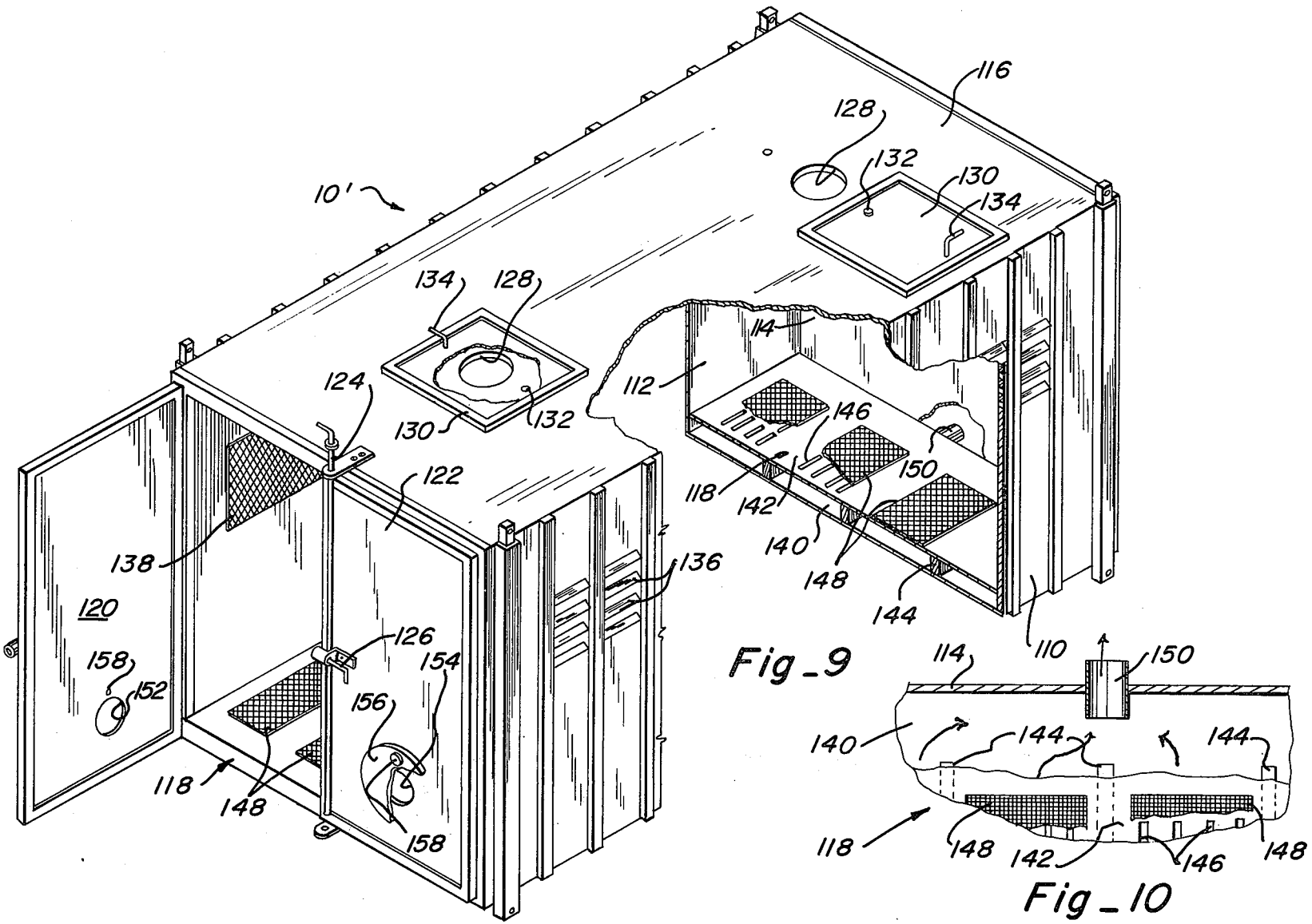
FIG. 9 is a diagrammatic perspective view, similar to FIG. 1, with parts broken away to show an alternative storage container.
FIG. 10 is an enlarged, fragmentary plan view of the floor of the storage container of FIG. 9 showing further details of the ventilating system in the floor.

An alternative storage container 10' is shown in FIG. 9 which includes opposite side walls 110 and 112, and end wall 114, a top wall 116 and a floor or bottom 118. The end wall opposite end wall 114 is formed by hinged doors 120 and 122 which are conveniently held in locked position by latches 124 and 126.

Top wall 116 is provided with a plurality of ports 128 through which container 10' may be filled with grain in the field, as by augers. Closures, such as pivoted closures 130, are pivotal from an open position about pivot pin 132 to a closed position where they can be locked after filling by a latch mechanism 134.

As in the previous embodiment, means is provided to permit circulation of air through the grain for drying and curing purposes during storage and transit. Thus, slots are provided in side walls 110 and 112 covered on the outside, as by louvers 136, to prevent the ingress of rain and dirt and covered on the inside, as by screens 138, to prevent smaller particles of grain from working out of the storage container. A means is provided for circulating air through the storage container which is completely confined within floor 118. As can be seen in FIGS. 9 and 10, the floor includes a lower panel 140 and an upper panel 142 spaced therefrom by floor joist 144 which conveniently provide a space for circulation of air thereunder. The upper floor is also provided between each floor joist with slots 146 conveniently covered with screens 148 to prevent grain stored therein from falling through the slots.

Advantageously, a discharge tube 150 extends through end wall 114 into the space between lower panel 140 and upper panel 142 and is in communication with each passageway formed by the upper and lower panels and the floor joist. As shown in FIG. 10, the floor joist terminates just short of end wall 114 to provide communication with all passageways. Thus, by attaching a blower to tube 150 air can be drawn in through louvers 136 and down through the grain and through slots 146 into the passageways formed in floor 118 and discharged through tube 150. Although not shown, an aperture can be provided, similar to aperture 66 of FIG. 1, for inserting a probe to measure grain humidity.

After the grain has been transported to its ultimate point of use, doors 120 and 122 must be opened to discharge the grain therefrom. However, the pressure of the grain against the doors will make it difficult, if not impossible, to operate latches 124 and 126. Therefore, to relieve the pressure on the doors, ports 152 and 154 are provided in doors 120 and 122, respectively, as shown and are normally closed by covers, such as covers 156, each of which may be pivoted about a pivot pin 158 to open its respective port. Thus, by opening covers 126 the grain will be allowed to run out ports 152 and 154 to relieve the pressure so that the doors can be opened. After opening the doors, the container 10' may be tipped up so that the grain slides out of the container through the open doors into a suitable receptacle. Furthermore, bulk cargo can be re-shipped in the container and can be loaded therein through the doors 120 and 122.

Since the containers are large and sturdy, they serve a dual purpose when grain is shipped overseas. Instead of being returned empty, they can be loaded with quantities of small articles, packaged or unpackaged, which are delicate and valuable, such as electronic appliances and the like, which are then delivered to ports or cities close to their original point of departure.

The invention has been described in detail with particular reference to preferred embodiments thereof, but it will be understood that variations and modifications can be effected within the spirit and scope of the invention.

What is claimed is:

1. A grain storage and shipping container which is stackable with similar containers for transporting grain from one location to another, said shipping container comprising:

a receptacle for receiving and retaining a cargo of grain in loose bulk form;

the receptacle being in the general form of a rectangular box having upright side walls and end walls, a horizontal bottom wall, and a top wall in parallel relation to said bottom wall so that another container can be stacked on top of said container;

closure means in at least one of said walls for filling and/or discharge of grain in loose bulk form;

first airflow port means extending along the major portion of the length of at least one side wall in the vicinity of its upper margin and opening through the side wall to the exterior atmosphere;

second airflow port means extending through a lower portion of an end wall below the level of the major portion of the cargo to be carried and opening to the exterior atmosphere, said second port means being connectable on the exterior of said container to power operated means;

duct means associated with the bottom wall and extending generally parallel to the side wall containing the first port means and flow-connected to the second port means;

the duct means being perforated at various points along its length to permit the flow of air between its interior and exterior;

so that the power operated means can generate a continuous stream of atmospheric air flowing in through one of said port means and out through the other to withdraw excess moisture from the grain and transfer it to the exterior atmosphere;

the relative arrangement and spacing between the first and second port means serving to define a general flow path between them encompassing substantially all of the grain in the cargo.

2. A grain storage and shipping container, as claimed in claim 1, wherein said closure means includes:

a first closure means in one of said walls for filling said container with loose bulk grain; and second closure means in a second wall for discharging said grain and for use in refilling said container with bulk items.

3. A grain storage and shipping container, as claimed in claim 2, wherein:

said first closure means comprises at least one port in the top wall of said container through which said container can be filled by means of an auger; and said second closure means comprises at least one door in one of said end walls which can be swung open for dumping the grain out of the storage container and for refilling the storage container with bulk items.

4. A grain storage and shipping container, as claimed in claim 3, further including:

a port in said door which can be opened to relieve the pressure on said door prior to opening said door to dump the grain from said container.

5. A grain storage and shipping container, as claimed in claim 1, wherein said duct means includes;

ducts formed between upper and lower panels of said floor by means of floor joists extending between the upper and lower panel and terminating short of one of said end walls;

slots in the upper panel of said floor spaced between said floor joints; and a discharge tube in said one end wall connectable to a blower for drawing air into said container through said first airflow port means, through the grain, through said slots and along the ducts to be discharged through said discharge tube.

6. A method of handling grain in loose bulk form from harvest in the field to delivery at a final destination, comprising:

providing a plurality of ventilatable containers;

providing closure means in at least one wall of the containers for filling and/or discharge of grain in loose bulk form;

loading the loose grain in the field directly into the containers and securing the closure means in position;

storing the grain in the containers for predetermined periods of time;

periodically forcing streams of atmospheric air to flow through the container and through at least the major portion of the body of grain in each container for extended periods of time to remove excess moisture from the grain, repeating the procedure until the moisture content is reduced to a desired level;

loading the containers onto transport means;

and delivering the containers to their ultimate destination, with the cargos remaining in their original containers from initial loading in the field to arrival at their ultimate destination.

* * * * *